US006094179A

United States Patent [19]

Davidson

[11] Patent Number: 6,094,179

[45] Date of Patent: Jul. 25, 2000

[54] ANTENNA

[75] Inventor: Brian Davidson, Surrey, United Kingdom

[73] Assignee: Nokia Mobile Phones Limited, Espoo, Finland

[21] Appl. No.: 09/184,598

[22] Filed: Nov. 2, 1998

[30] Foreign Application Priority Data

Nov. 4, 1997 [GB] United Kingdom ..... 9723313

[51] Int. Cl.[7] ..... H01Q 1/36

[52] U.S. Cl. ..... 343/895; 343/702; 343/792.5

[58] Field of Search ..... 343/895, 900, 343/702, 725, 873, 792.5; H01Q 1/36

[56] References Cited

U.S. PATENT DOCUMENTS

| | | | |
|---|---|---|---|
| 4,160,979 | 7/1979 | Drewett | 343/895 |
| 4,658,262 | 4/1987 | DuHamel | 343/895 |
| 4,998,078 | 3/1991 | Hulkko | 333/109 |
| 5,276,920 | 1/1994 | Kuisma | 455/101 |
| 5,341,149 | 8/1994 | Valimaa et al. | 343/895 |
| 5,561,439 | 10/1996 | Moilanen | 343/846 |
| 5,627,550 | 5/1997 | Sanad | 343/700 MS |
| 5,657,028 | 8/1997 | Sanad | 343/700 MS |
| 5,680,144 | 10/1997 | Sanad | 343/700 MS |
| 5,828,342 | 10/1998 | Hayes et al. | 343/702 |
| 5,872,549 | 2/1999 | Huynh et al. | 343/895 |

FOREIGN PATENT DOCUMENTS

| | | |
|---|---|---|
| 0 198 578 A1 | 10/1986 | European Pat. Off. . |
| 1 367 232 | 9/1974 | United Kingdom . |

OTHER PUBLICATIONS

United Kingdom Search Report.

*Primary Examiner*—Don Wong
*Assistant Examiner*—Hoang Nguyen
*Attorney, Agent, or Firm*—Perman & Green, LLP

[57] ABSTRACT

An antenna for portable radio apparatus, comprising a conductive filament arranged in a tapering corrugated configuration having an envelope extending from a narrow portion to a wider portion. The conductive filament is arcuately disposed about a longitudinal direction of the tapering configuration, thereby forming a generally tubular antenna. The conductive filament may be fabricated using metal printing technology.

17 Claims, 4 Drawing Sheets

RADIATING ELEMENT WRAPPED AROUND CYLINDRICAL CORE

RADIATING ELEMENT WRAPPED AROUND CYLINDRICAL CORE

RADIATION DISTRIBUTION

ANTENNA

BACKGROUND OF THE INVENTION

The present invention relates to an antenna, in particular but not exclusively, to an antenna for portable radio apparatus.

Antennas for portable radio apparatus are generally required to be small, yet still have good radio frequency propagating characteristics. Conventional rod and spiral wound rod antennas, whilst having good radiation propagation characteristics, will generally be relatively long for example a quarter or three-eighths of a wavelength long. At typical radio telephone frequencies of 900 MHz this would result in a rod antenna, including its feed portion, being in the region of 60–85 mm long. As portable radio apparatus, in particular radio telephones, have reduced in size there has been a corresponding demand for a reduction in the size of the antenna. A typical configuration having a relatively low volume is the helical antenna, and these have been commonly adopted for use with radio telephones. However, such helical antennas are relatively narrow band which makes them unsuitable for radio telephone networks requiring relatively wide band-width operation such as the Japanese Personal Digital Cellular (PDC) radio telephone system which has up and down links centred around 936 MHz and 847 MHz respectively for the 800 MHz frequency band system.

SUMMARY OF THE INVENTION

The present invention aims to address at least some of the shortcomings of the prior art, and provides an antenna for portable radio apparatus, comprising a conductive filament arranged in a tapering corrugated configuration having an envelope extending from a narrow portion to a wider portion, wherein the conductive filament is arcuately disposed about a longitudinal direction of the tapering configuration, thereby forming a generally tubular antenna.

The antenna is adapted to be operative with a high current density in the narrow region.

A feed point for the antenna may be disposed adjacent the narrow portion.

An advantage of an embodiment in accordance with the present invention is that the antenna has a wider band width than a conventional helical antenna of comparable volume operating in substantially the same frequency range. Thus, such an embodiment is suitable for applications in which relatively broad band antennas are required, such as the Japanese PDC radio telephone system. Additionally, the far field radiation pattern is similar to that obtained from a conventional antenna, yet it is from an antenna of lower volume. Further, the near-field of the antenna is disposed closer to the antenna structure than for conventional antennas.

In a preferred embodiment a conductive filament is supported by an insulating member. This provides good mechanical strength for the antenna and reduces the likelihood of damage occurring to the antenna during use.

Preferably, the conductive filament is conformal with the surface of the insulating member, which provides for an antenna having a particularly low profile. Additionally, the conductive filament may be placed on the surface of the insulating member by a number of well-known processes, for example "printing" such as is used for the manufacture of printed circuit boards, deposition using sputtering and vacuum techniques, 3D image transfer or by manufacturing the conductive filament on a plastic film which is then wrapped around the insulating member. The plastic film may be of the same material as the insulating member. By appropriately treating, eg heat-treating, the plastic film when it is wound round the insulating member, a substantially homogenous antenna element will be created. Such an antenna is mechanically robust.

The conductive filament may be made from a copper-nickel-gold mixture.

Suitably, the insulating member may be hollow, which allows for a material having a relatively high dielectric constant to be inserted within the insulating member. This has the advantage that the antenna radiation nearfield is closely confined to the conductive filament due to the presence of the high dielectric constant material. Optionally, a radio frequency absorber, reflecter or shield could be placed inside the insulative member, in order to inhibit radiation from the conductive filament in a direction through the body of the insulating member.

The dielectric constant of the material inserted into the insulating member may be greater in a region proximal to the wider portion of the tapered corrugated configuration than in a region proximal to the narrow portion. This would result in the antenna radiation nearfield in the region of the wider portion being more closely confined to the conductive filament than would otherwise be the case.

Typically, the antenna is ¼ wave or ⅜ wave monopole antenna, which is a suitable configuration for an embodiment in accordance with the present invention.

The conductive filament may be corrugated in a number of ways, for example it may be an undulating meander-line configuration, or a saw tooth configuration or a castellated configuration.

BRIEF DESCRIPTION OF THE DRAWINGS

Specific embodiments in accordance with the invention will now be described, by way of example only, and with reference to the following drawings:

FIG. 5 shows an:

(a) undulating meander line configuration, (b) saw tooth configuration, (c) castellated configuration for the conductive filament.

DETAILED DESCRIPTION OF THE INVENTION

Figure 1:
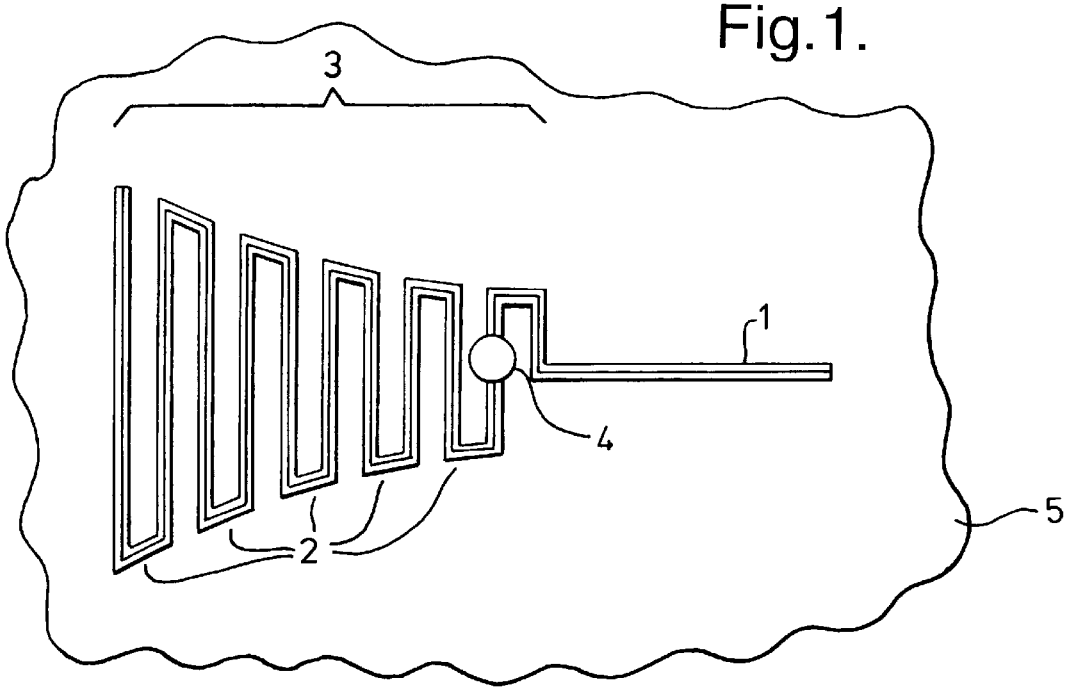
FIG. 1 shows a metalisation pattern on a plastic film in accordance with a first embodiment of the invention.

In accordance with a first embodiment of the present invention, FIG. 1 shows a thin metal strip 1 supported on a carrier medium 5 such as a plastic film. The metal strip 1 is a mixture of copper, nickel and gold. The thickness of the metalisation needs to be at least greater than the skin depth penetration for the frequency of operation. The metal strip 1 is corrugated and forms a series of "castellations" 2. The amplitude of the castellations increases towards an end of the metal strip 1 such that the amplitude is tapered over an envelope 3. The greatest near-field is expected to originate from point labelled reference 4. The method of forming the corrugated metal strip 1 on plastic film 5 may be by any suitable method such as printing, vacuum deposition, sputtering, 3D image transfer or the like. The metal strip 1 is formed into a generally tubular antenna having a generally constant cross-section in at least the portion of the antenna comprising the envelope 3.

Figure 2A:
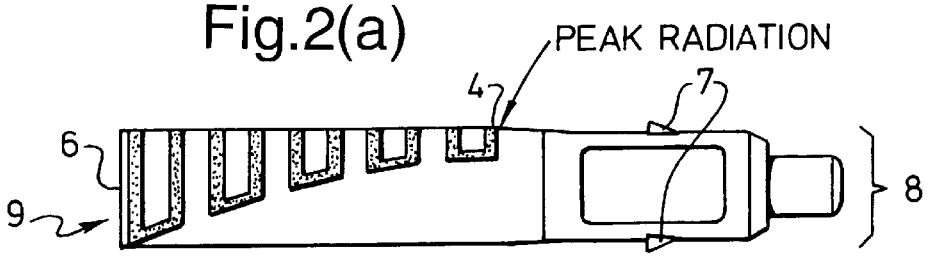
FIG. 2*a* shows the plastic film of FIG. 1, wrapped around a cylindrical core.

With reference to FIG. 2*a*, the antenna 9 is formed by wrapping plastic film 5 around a cylindrical core 6 made of a suitable insulating material. The insulating material may be a plastics material similar or even identical to that from which plastic film 5 is formed. By appropriate treatment, such as heat treatment, a substantially homogenous composite antenna 9 may be formed comprising the cylindrical core 6, plastic film 5 and the corrugated metal strip 1. The cylindrical core 6 includes detents 7 forming a part of a bayonet connection 8. Such a bayonet connection allows for push fitting of the antenna 9 into a housing of a radio telephone, for example. Additionally, by appropriately configuring the detent and co-operating attachment located on the housing of the radio telephone, the orientation of the antenna with respect to the housing may be controlled. This facilitates the manufacture of such radio telephones.

Figure 2B:
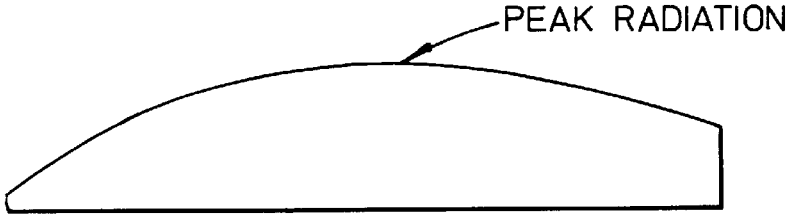
FIG. 2*b* shows a typical near-field intensity distribution for the configuration shown in FIG. 2*a;*

FIG. 2*b* shows the distribution of radiation from the antenna 9 shown in FIG. 2*a*. Peak near-field intensity is shown to occur from the region labelled 4 in FIG. 1 and 2*a*. Region 4 also corresponds to a section of the metal strip 1 which has a relatively high current density compared to the rest of the metal strip 1 when the antenna 9 is in operation.

The amplitude of respective corrugations 2 of the metal strip 1, and the radius of curvature of cylindrical core 6 are appropriately dimensioned such that region 4 of metal strip 1 is positioned on one side of the cylindrical core. Preferably the region 4 is confined to an arc over the surface of cylindrical core 6 extending no greater than $\pi$ radians, and preferably within the range $\pi/4$ to $2\pi/3$ radians.

Such a configuration allows region 4 of the metal strip 1 which has the greatest current density to be kept to one side of the antenna 9. Thus, antenna 9 may be located on a portable radio apparatus such as a radio telephone, with region 4 positioned such that when the radio apparatus is in use the peak near-field intensity region radiates into free space. This would reduce the de-tuning effect of any materials which are positioned relatively close to antenna 9 when the radio apparatus is in use.

The overall length of metal strip 1 is determined by the nature of the antenna which is intended to be constructed. For example, for a quarter-wave monopole antenna the total length of metal strip 1 is calculated based upon the effective dielectric constant for the antenna, ie whether substantially in freespace or dielectric loaded. This can be expressed algebraically as $l=c/(4f\sqrt{\epsilon_{eff}})$, where l is the length of the antenna, c is the speed of light in a vacuum, f is the centre frequency of the antenna and $\epsilon_{eff}$ is effective permittivity. However, since the metal strip is then corrugated, and it is well know to a skilled person that there may be coupling between respective corrugations, the gap between adjacent corrugations (pitch) should be sufficient to inhibit such coupling, eg the gap should be at least the width of the metal strip 1. The amplitude and pitch of the corrugations 2, the overall length of metal strip 1 for a given centre operating frequency of the antenna and the diameter of the cylindrical core are arrived at by trial and error, taking into account the volume the antenna is to take up. The tapered envelope 3 is determined to also take into account these factors. With the foregoing design parameters in mind, a person of ordinary skill in the art will be able to arrive at an appropriate configuration for a desired frequency of operation and antenna volume.

Figure 3:
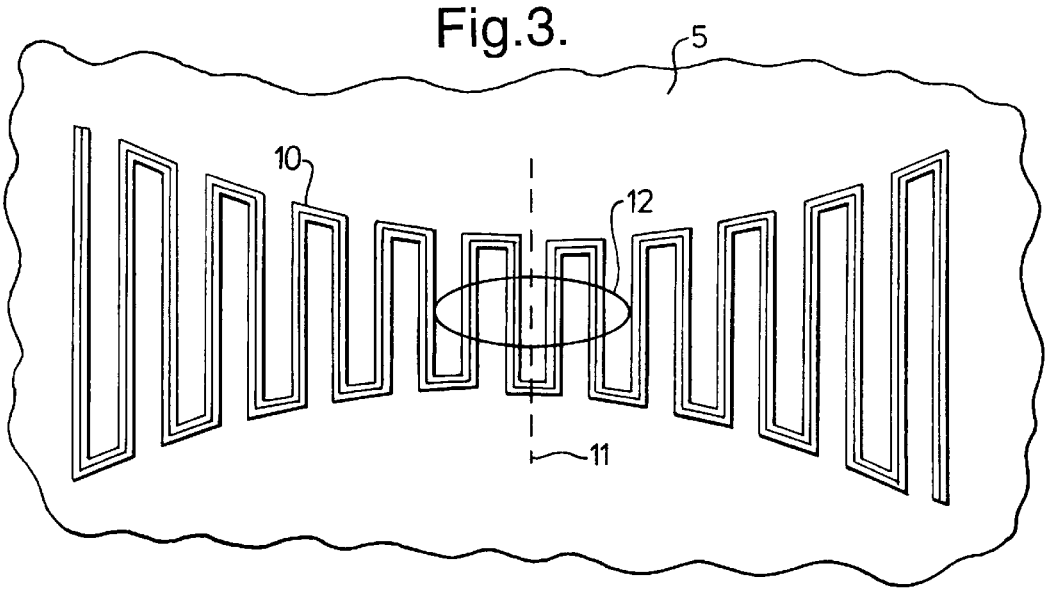
FIG. 3 shows an antenna with a hollow support having a high dielectric low-loss material inserted inside.

A corrugated configuration suitable for a half-wave antenna is shown in FIG. 3. The metalisation pattern 10 is deposited on a plastic film 5, and in this instance is substantially symmetrical about a centre line 11. The peak radiation region, or high current density region, is shown labelled reference 12. Plastic film 5 is formed around cylindrical core 6 in order to form a half-wave dipole antenna utilising a corrugated metal strip configuration. The antenna may be assembled in the manner described in relation to FIGS. 1, 2 and 4 above.

Figure 4A:
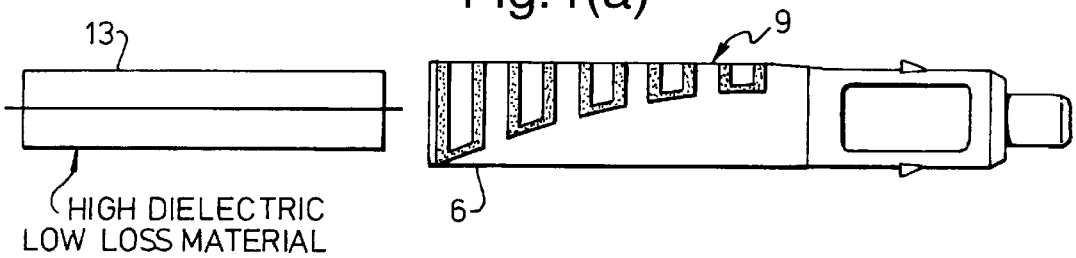
FIG. 4 shows a configuration suitable for a halfwave antenna.
Figure 4B:
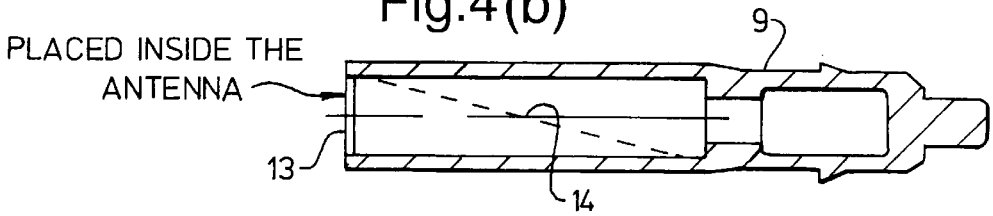

FIG. 4*a* shows an antenna 9 formed on a hollow cylindrical core 6 and having a high dielectric low-loss material 13 ready for insertion into the hollow cylindrical core. FIG. 4*b* shows a cross section of antenna 9 having the high dielectric low-loss material 13 placed inside the antenna. Dotted line 14 graphically represents a dielectric constant gradient which may be incorporated into a high dielectric low-loss material 1 3 in order to provide a greater dielectric constant in the wider portion of the antenna, thereby confining the near-field close to the metalisation.

Figure 5A:
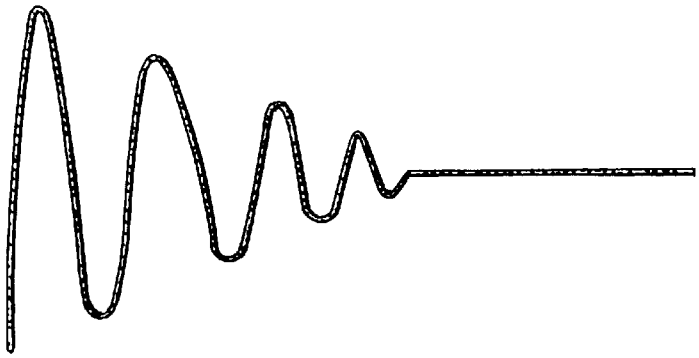
Figure 5B:
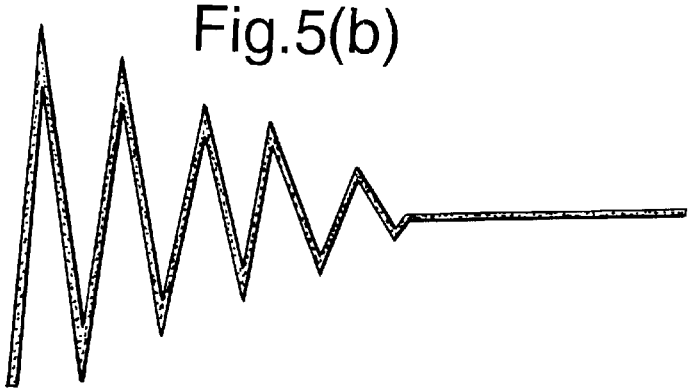
Figure 5C:
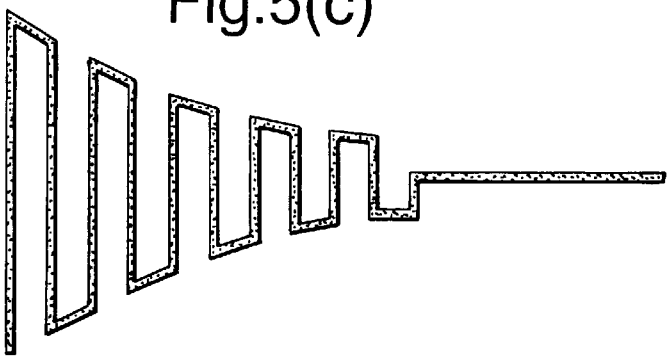

Metal strip 1 may be corrugated in a number of different patterns. FIG. 5*a* shows an undulating meander line pattern, FIG. 5*b* shows a saw tooth pattern and FIG. 5*c* shows a castellated pattern, which has been used to illustrated various embodiments in accordance with the invention.

Figure 6:
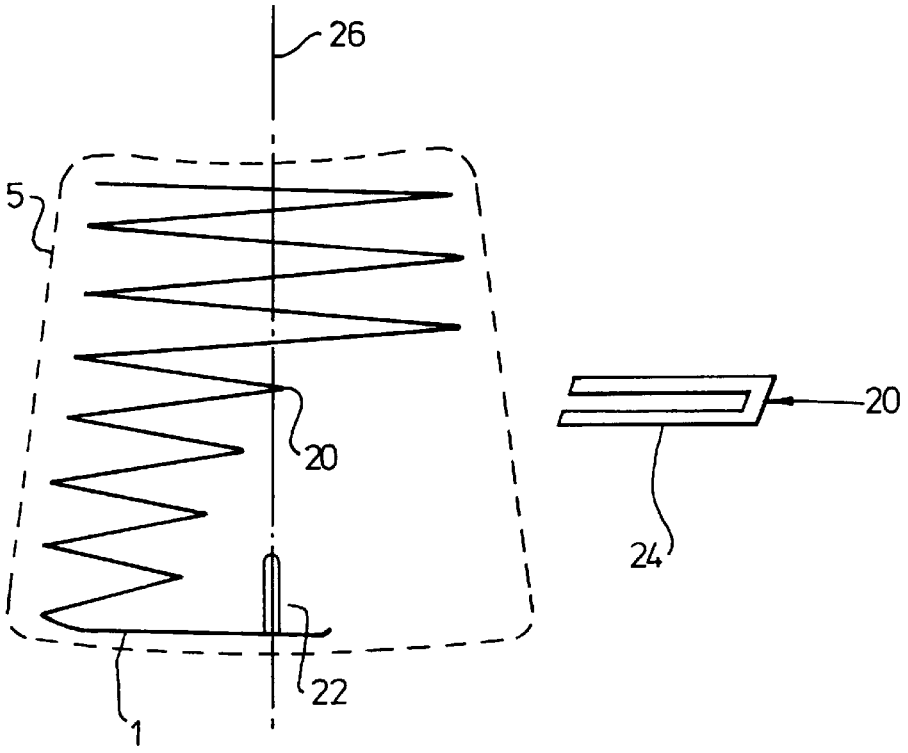
FIG. 6 shows a further embodiment in accordance with the invention.
Figure 6:
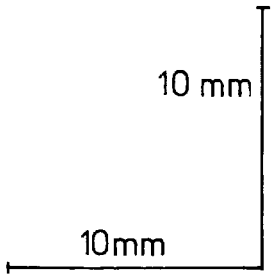

FIG. 6 shows a further embodiment in accordance with the invention, suitable for use in the frequency range around 800–950 MHz. An offset tapered saw tooth patterned metal strip 1 is supported on plastic film 5. The film 5 is a polyester material. Reference 22 shows metalisation suitable as a feed for an antenna formed from the film 5 being wound into a cylinder about axis 26. Typically, feed 22 is coupled to a co-axial feed line, which is further coupled to the RF front end of a transceiver. An antenna utilising such a configuration, may be formed in the manner described in relation to FIGS. 1, 2 and 4 above.

The saw tooth pattern may be replaced by castellations substantially as shown by reference 24, where the centre of each castellation corresponds to the peak of each saw tooth, reference 20.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

In view of the foregoing description it will be evident to a person skilled in the art that various modifications may be made within the scope of the invention. For example, the type of corrugation is not limited to those described above with reference to the drawings, but may be of any suitable type. Additionally, the cross-section of the antenna need not be circular, but may be ovoid, rectangular or square for example.

What is claimed is:

1. A generally tubular antenna for a portable radio apparatus, comprising a conductive filament arranged in a tapering corrugated configuration having an envelope extending from a narrow portion to a wider portion, wherein the conductive filament is arcuately disposed about said tubular antenna in a longitudinal direction of the tapering configuration, the tubular antenna having a generally constant cross-section at least in the portion of the antenna comprising the envelope.

2. An antenna according to claim 1, adapted to operate with a high current density in the narrow portion of the antenna.

3. An antenna according to claim 1 wherein a feed point for the antenna is disposed adjacent said narrow portion.

4. An antenna according to claim 1, wherein the conductive filament is supported by insulating member.

5. An antenna according to claim 4, wherein the conductive filament is conformal with a surface of the insulating member.

6. An antenna according to claim 4, wherein the insulating member is hollow.

7. An antenna according to claim 1, wherein the antenna is a quarter wave or three-eights wave monopole antenna.

8. An antenna according to claim 1, wherein the conductive filament comprises:

i) a meander line configuration; or ii) a saw tooth configuration; or iii) a castellated configuration.

9. An antenna as claimed in claim 1, wherein the spacing between adjacent corrugations is at least the width of the conductive filament.

10. A radio telephone comprising an antenna as claimed in claim 1.

11. An antenna for portable radio apparatus, comprising a conductive filament arranged in a tapering corrugated configuration having an envelope extending from a narrow portion to a wider portion, wherein the conductive filament is arcuately disposed about a longitudinal direction of the tapering configuration, thereby forming a generally tubular antenna, the conductive filament being supported by an insulating member, and wherein a material having a relatively high dielectric constant is disposed within the insulating member.

12. An antenna according to claim 11, wherein the dielectric constant of the material is greater in a region proximal to the wider portion of the tapered corrugated configuration than in a region proximal to the narrow portion.

13. A generally tubular antenna for a portable radio apparatus, comprising a conductive filament arranged in a tapering corrugated configuration having an envelope extending from a narrow portion to a wider portion, wherein the conductive filament is arcuately disposed about said tubular antenna in a longitudinal direction of the tapering configuration, the tubular antenna having a generally cylindrical cross-section in the portion of the antenna comprising the envelope.

14. An antenna according to claim 13, which provides peak near-field intensity from the narrow portion of the conductive filament.

15. An antenna according to claim 14, wherein the narrow portion is confined to an arc over a cylindrical surface of the antenna extending no greater than from about $\pi/4$ to about $2\pi/3$ radians.

16. An antenna according to claim 14, wherein the narrow portion is arranged on said antenna so that the peak near-field intensity provided by the narrow portion of the antenna radiates into free space.

17. An antenna according to claim 14 wherein a gap between adjacent corrugations of the conductive filament is sufficiently large to inhibit coupling between the corrugations.

* * * * *